US005111950A

United States Patent [19]

Wylenzek

[11] Patent Number: 5,111,950

[45] Date of Patent: May 12, 1992

[54] SHIPPING CONTAINER

[76] Inventor: Kurt Wylenzek, c/o Cross & Co., Inc., 5535 Harvey Wilson, Houston, Tex. 77020

[21] Appl. No.: 580,666

[22] Filed: Sep. 11, 1990

[51] Int. Cl.[5] ..... B65D 88/00

[52] U.S. Cl. ..... 220/1.5; 108/55.1; 108/55.5; 206/386; 220/4.28; 220/8

[58] Field of Search ..... 220/1.5, 4.28, 8; 206/386, 597, 599, 600; 108/55.1, 55.5, 56.1, 56.3

[56] References Cited

U.S. PATENT DOCUMENTS

| | | | |
|---|---|---|---|
| Re. 26,426 | 7/1968 | De Remer et al. | 206/597 |
| 3,180,607 | 4/1965 | Lee | 220/1.5 |
| 3,401,814 | 9/1968 | Chiswell et al. | 220/1.5 X |
| 3,478,995 | 11/1969 | Lautzenhiser et al. | 108/55.5 X |
| 3,570,698 | 3/1971 | Dougherty | 220/1.5 |
| 3,753,407 | 8/1973 | Tilseth | 108/55.5 X |
| 3,797,691 | 3/1974 | Williams, Jr. | 220/1.5 |
| 3,807,581 | 4/1974 | Nichols | 220/1.5 X |
| 4,360,115 | 11/1982 | Saunders | 220/1.5 |
| 4,416,385 | 11/1983 | Clare et al. | 220/1.5 |
| 4,738,371 | 4/1988 | Wakeman | 220/1.5 X |

*Primary Examiner*—Bryon P. Gehman
*Attorney, Agent, or Firm*—Neal J. Mosely

[57] ABSTRACT

A shipping container has a pallet with a metal base formed of channel and a floor panel secured to the base. Corner posts of square metal tubing extend vertically from the corners of the pallet base and have cover holding members at their upper ends. An inverted box-shaped cover having vertical recesses in each corner in slidably received on the pallet corner posts. Tie-down brackets slidably mounted in the floor panel receive straps to secure items stacked on the pallet floor panel. Slots in the pallet base and in the cover facilitate lifting the pallet and/or the cover by forklift or other lifting devices. The cover is raised to a position above the floor panel of the pallet and the cover holding members are pivoted to engage the cover such that the cover is supported on the posts above the floor panel. The cover could also be completely removed from the pallet. With the cover raised or removed, items can be stacked on the pallet and tied down by straps passed over the top of the stacked items. After the stacked items are secured, the cover holding members are disengaged from the cover and the cover is lowered onto the pallet base. A horizontal flange extends outwardly from the open bottom of the cover and is received on the base of the pallet when the cover is lowered. Locking brackets on the base channel are received in slots in the cover flange when it is in the lowered position. A wedge bar is inserted into the locking bracket to lock the cover onto the pallet.

13 Claims, 4 Drawing Sheets

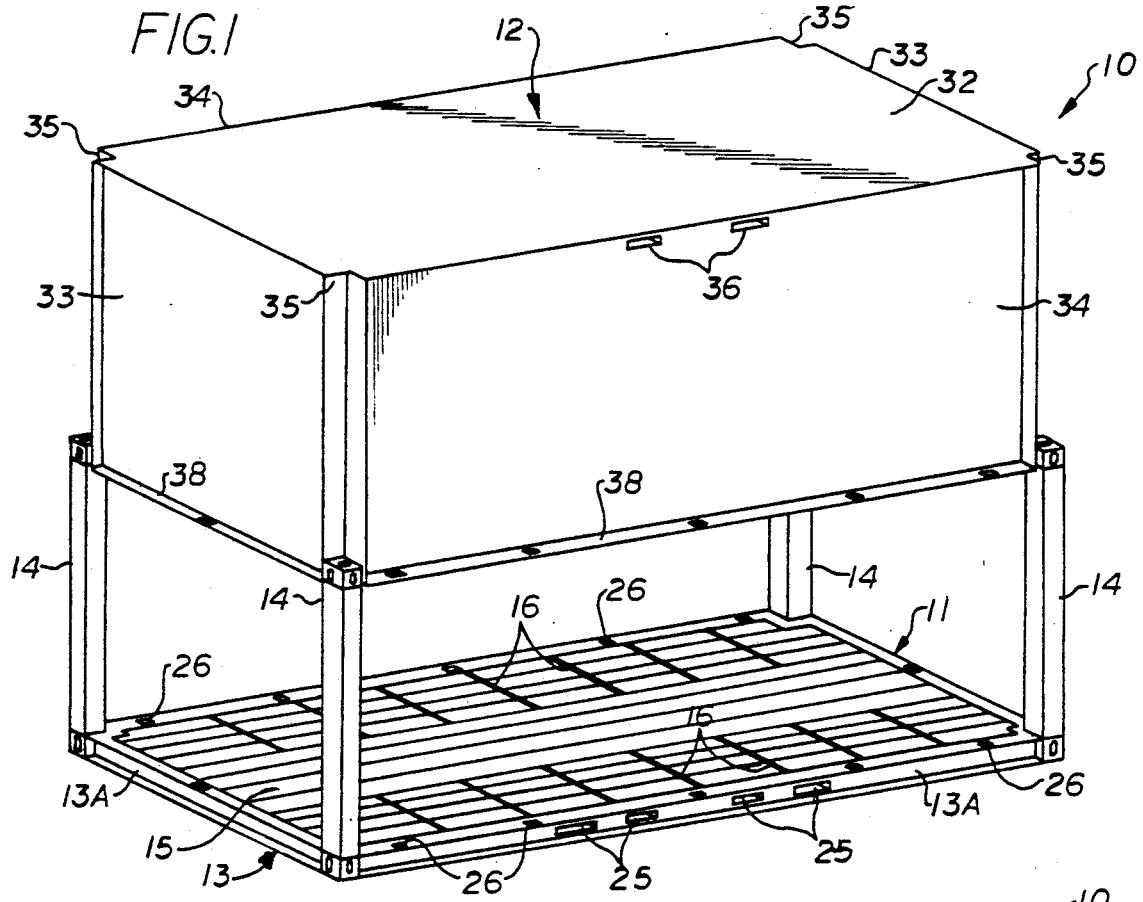
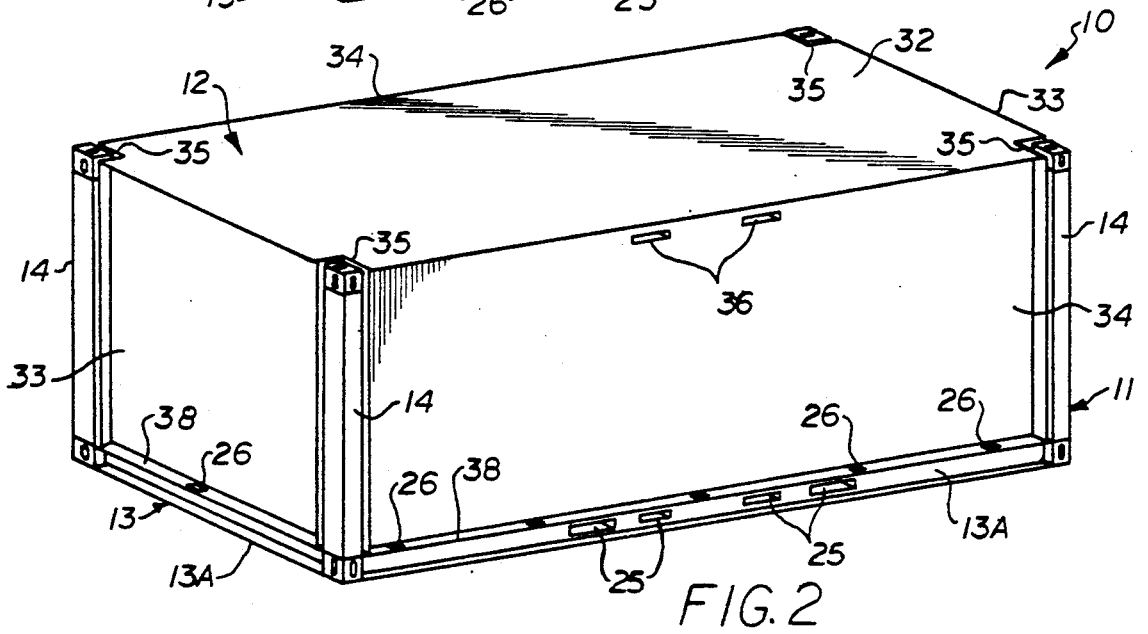
FIG. 2

FIG. 6
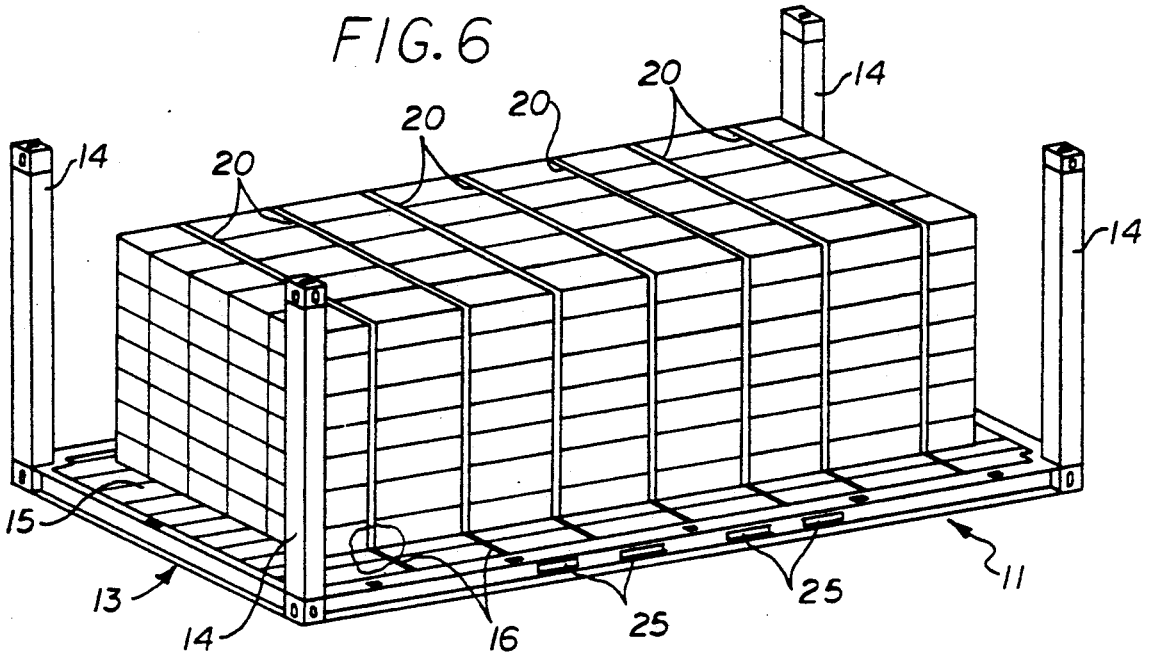
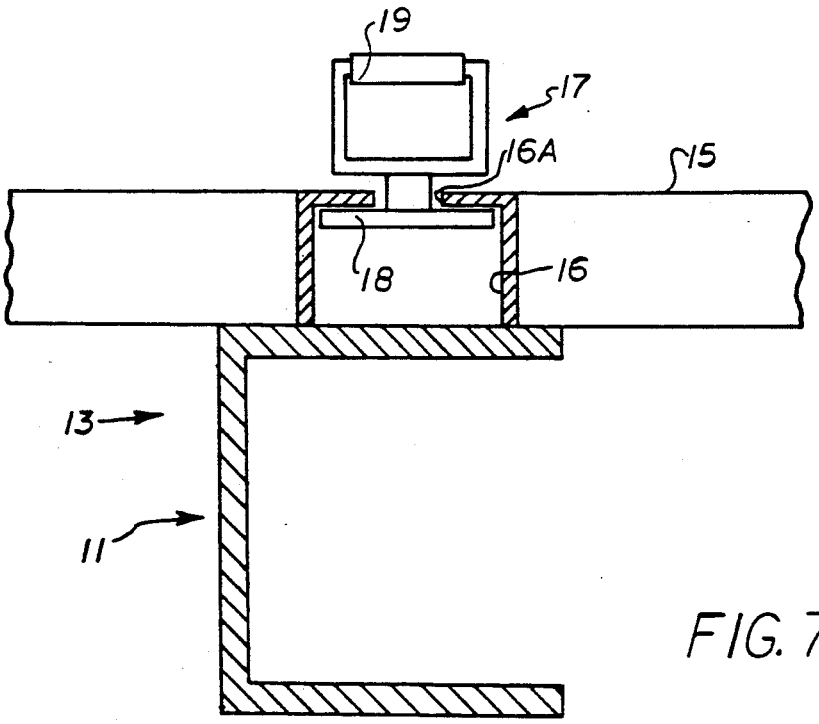
FIG. 7

SHIPPING CONTAINER

BACKGROUND OF THE INVENTION

1. Field of the Invention

This invention relates generally to shipping containers, and more particularly to a shipping container having a pallet member having corner posts and a cover slidable engaged therewith for completely enclosing and shipping items stacked and secured on the pallet.

2. Brief Description of the Prior Art

The prior art contains numerous references in the field of shipping containers including Kennard U.S. Pat. No. 3,398,850; Chiswell U.S. Pat. No. 3,401,814; Williams U.S. Pat. No. 3,797,691; Saunders U.S. Pat. No. 4,360,115; Clare U.S. Pat. No. 4,416,385; and Wakeman U.S. Pat. No. 4,738,371.

Kennard U.S. Pat. No. 3,398,850 discloses a collapsible parallelepipedal freight container having a unit top, a unit base, two opposite sides releasably secured at their upper and lower edges to the base and top and each divided horizontally into similar sections secured together by one-way hinges which provide for the sides to be collapsed inwards, and at each end an end wall horizontally divided into two flaps secured b two-way hinges to adjacent end edges of the sides so that the flaps can be out-turned as doors and can be inturned against the sides to permit the container to be collapsed into a compact unit.

Chiswell U.S. Pat. No. 3,401,814 discloses a collapsible shipping container having a base frame supporting a decking panel, which in turn releasably supports elongated corner posts positioned complementary to limited vertically extending peripheral corner walls of the base frame. The base frame includes channels for supporting side panels which abut flange members of the corner posts and which are detachably connected thereto, and which together support in complementary releasable engagement a roof frame having limited downwardly extending walls forming a roof channel. A door panel completes the assembly and is locked from the outside.

Williams U.S. Pat. No. 3,797,691 discloses a container consisting of a plurality of modules interconnected one to another to form a preselected, standard size assembly to permit the movement thereof through existing transportation systems as a unit. Break apart features between the several modules facilitate the handling and loading thereof at times other than during shipment.

Saunders U.S. Pat. No. 4,360,115 discloses a multipurpose cargo shipping container having provision for optional individual unit use or plural interlocked use. On the one hand the individual unit may be utilized for carrying relatively high density cargo, while on the other, a pair of interlocked units forming a container may carry low package density cargo.

Clare U.S. Pat. No. 4,416,385 discloses a stackable freight container comprising a rigid bottomless container body and a separate freight-carrier pallet which can be bolted into the open underside of the body by means of shoot-bolts to close the container and form its load-carrying floor. When the closed container is placed on a flat supporting surface the lower edges of the body rest on the surface with the loaded pallet supported clear of the surface by the shoot-bolts, the weight of the loaded pallet then preventing the withdrawal of the shoot-bolts. To open the container it must be lowered on to packing to take the weight of the loaded pallet off the shoot-bolts so that they can be withdrawn.

Wakeman U.S. Pat. No. 4,738,371 discloses a novel reusable, rollable wrap for securing items stacked on a rectangular pallet. The wrap includes a flexible sheet, having ends which are secured together by detachable means, such as a zipper, and a plurality of parallel, stiff, elongate corner support members which are secured to the sheet at spaced-apart intervals therealong between the ends of the sheet.

From the foregoing, it should be recognized that a need has long existed for shipping containers which facilitate cargo handling, are practical and adaptable for utilization with different types of cargo, are sturdy in construction, inexpensive to manufacture, and still maintain simplicity in design.

The present invention is distinguished over the prior art in general, and these patents in particular, by a shipping container which has a pallet member and an inverted box-like cover movably received thereon. The pallet has a metal base formed of channel and a floor panel secured to the base. Corner posts of square metal tubing secured at the corners of the base extend vertically upwardly therefrom. Tie-down brackets slidably mounted in the floor panel receive straps to secure items stacked on the pallet floor panel. Each corner of the cover is provided with a vertical recess to slidably receive the pallet corner posts. Cover holding members at the upper end of the corner posts pivot outwardly to releasably engage the cover in its raised position. Slots in the pallet base and in the cover facilitate lifting the pallet and/or the cover by forklift or other lifting devices.

The cover is raised to a position above the floor panel of the pallet and the cover holding members at the upper ends of the posts are rotated to engage the cover member such that the cover is supported on the posts above the floor panel. The cover could also be completely removed from the pallet. In the cover raised or removed position, items to be shipped can be stacked on the pallet and tied down by straps passed over the top of the stacked items. After the stacked items are secured, the cover holding members are disengaged from the cover and the cover is lowered onto the pallet base. A horizontal flange extends outwardly from the open bottom of the cover and is received on the base channel of the pallet when the cover is lowered. Locking brackets on the base channel are received in slots in the cover flange when it is in the lowered position. A wedge bar is inserted into the locking bracket to lock the cover onto the pallet.

SUMMARY OF THE INVENTION

It is therefore an object of the present invention to provide a new and improved shipping container.

It is another object of this invention to provide a shipping container of improved construction which will offer operational advantages during loading and unloading, and will also provide better protection of the items being shipped.

Another object of this invention is to provide a shipping container having a cover slidably engaged on a pallet which can be raised to allow access to the pallet from all sides or which can be completely removed from the pallet.

Another object of this invention is to provide a shipping container having a cover slidably engaged on a pallet which is lowered and locked onto the pallet to prevent exposure of the items being shipped and provide improved security of the items being shipped Another object of this invention is to provide a shipping container having a cover slidably engaged on a pallet which can be easily handled by conventional lifting devices, such as a forklift.

Another object of this invention to provide a shipping container having a pallet with means for securing stacked items in place on the floor of the pallet whether fully loaded or partially loaded.

A further object of this invention is to provide a shipping container having a cover slidably engaged on a pallet which has corner posts with releasable means for holding the cover in place after the cover it has been lifted.

A still further object of this invention is to provide a shipping container having a cover slidably engaged on a pallet which is simple in construction, economical to manufacture, and rugged and durable in use.

Other objects of the invention will become apparent from time to time throughout the specification and claims as hereinafter related.

The above noted objects and other objects of the invention are accomplished by a shipping container which has a pallet member and an inverted box-like cover movably received thereon. The pallet has a metal base formed of channel and a floor panel secured to the base. Corner posts of square metal tubing secured at the corners of the base extend vertically upwardly therefrom. Tie-down brackets slidably mounted in the floor panel receive straps to secure items stacked on the pallet floor panel. Each corner of the cover is provided with a vertical recess to slidably receive the pallet corner posts. Cover holding members at the upper end of the corner posts pivot outwardly to releasably engage the cover in its raised position. Slots in the pallet base and in the cover facilitate lifting the pallet and/or the cover by forklift or other lifting devices.

The cover is raised to a position above the floor panel of the pallet and the cover holding members at the upper ends of the posts are rotated to engage the cover member such that the cover is supported on the posts above the floor panel. The cover could also be completely removed from the pallet. In the cover raised or removed position, items to be shipped can be stacked on the pallet and tied down by straps passed over the top of the stacked items. After the stacked items are secured, the cover holding members are disengaged from the cover and the cover is lowered onto the pallet base. A horizontal flange extends outwardly from the open bottom of the cover and is received on the base channel of the pallet when the cover is lowered. Locking brackets on the base channel are received in slots in the cove flange when it is in the lowered position. A wedge bar is inserted into the locking bracket to lock the cover onto the pallet.

BRIEF DESCRIPTION OF THE DRAWINGS

FIG. 1 is an isometric view of a shipping container in accordance with the present invention shown with the cover member in a raised position above the pallet member.

FIG. 2 is an isometric view of the shipping container of FIG. 1 shown with the cover in the lowered position.

FIG. 6 is an isometric view of the pallet of the shipping container of FIG. 1 shown with the cover removed and items stacked on the pallet floor.

FIG. 7 is a detail of the floor of the pallet member showing a tie-down bracket for securing items stacked on the pallet floor.

DESCRIPTION OF THE PREFERRED EMBODIMENT

Figure 3:
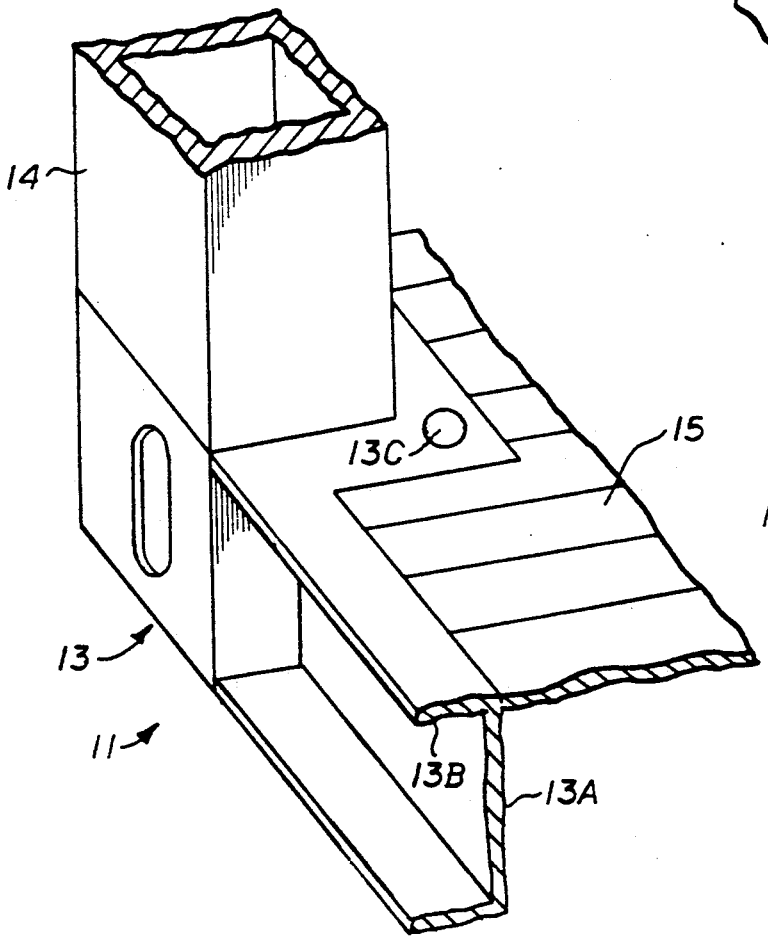
FIG. 3 is a detail of a portion of the corner of the pallet member and corner post of the pallet of the shipping container.

Referring to the drawings by numerals of reference, there is shown in FIGS. 1, 2, and 3, a preferred shipping container 10 in accordance with the present invention. The shipping container 10 comprises a pallet member 11 and a cover member 12. The pallet 11 has a lightweight metal base 13 formed of C-shaped channel 13A and vertical corner posts 14 formed of square metal tubing secured at their bottom ends to the corners of the base 13 and extending ½" below channels 13A. A rectangular wooden floor panel 15 is secured to the metal base 13. Floor panel 15 may be of metal where desirable. Cover member has guide pins which fit holes 13C (FIG. 3) when closed.

The floor panel 15 has a series of parallel spaced slots 16 which extend transversely inwardly from each longitudinal side edge. As seen in FIG. 7, the slots 16 are of generally U-shaped cross section with a narrow slot 16A at the top end. A tie-down bracket 17 is slidably retained in each slot 16. The tie-down bracket 17 is a generally inverted T-shaped configuration having a bottom flange 18 received in the slot 16 in a sliding T-slot arrangement. The upper end of the tie-down bracket 17 has a roller 19 rotatably mounted thereon. As shown in FIG. 6, a series of flexible slings or straps 20 are secured at their ends on the tie-down brackets 17 to secure items stacked on the pallet floor panel 15.

Figure 5:
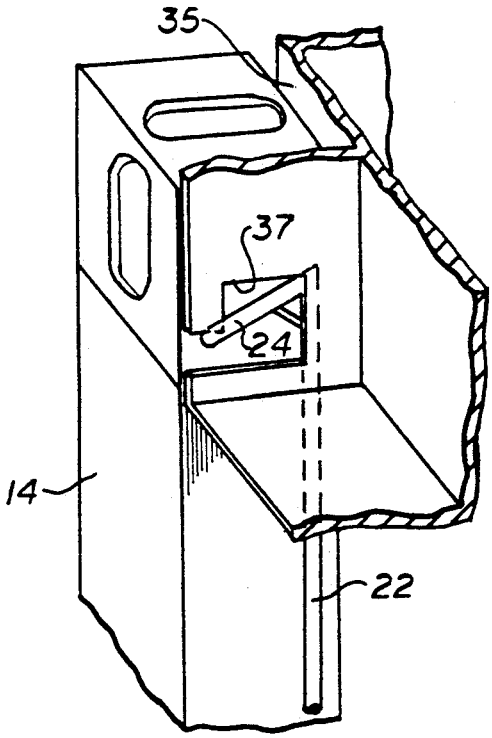
FIG. 5 is a detail of the upper portion of a corner post showing the lower portion of the cover engaged by the cover support member.
Figure 4:
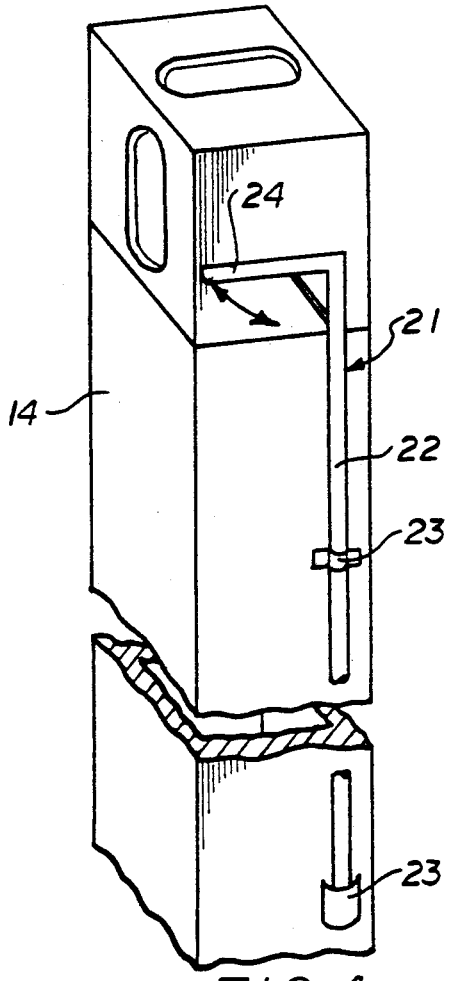
FIG. 4 is a detail of the upper portion of a corner post member showing the cover support member pivotally mounted thereon.

As seen in FIGS. 4 and 5, a cover holding member 21 is pivotally mounted on one side of each post 14. The cover holding member 21 is an inverted L-shaped bar or rod having its vertical portion 22 pivotally secured by brackets 23 to one side wall of each post 14. The horizontal portion 24 of each cover holding member 21 pivots between a stored position against the post side wall 14( FIG. 4) and a holding position outwardly therefrom (FIG. 5).

Referring again to FIGS. 1 and 2, a series of longitudinally spaced slots 25 are formed in the vertical web portion of the C-shaped channel 13A of the pallet base 13 to facilitate lifting the container 10 by forklift or other conventional lifting devices.

Figure 8:
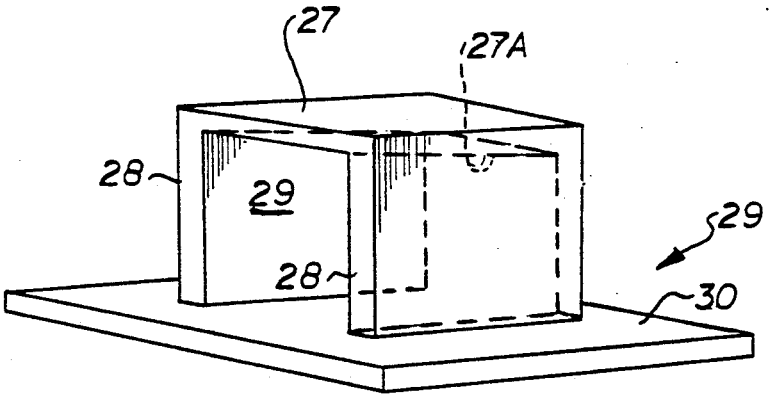
FIG. 8 is an isometric view of a locking bracket for locking the cover onto the pallet.
Figure 10:
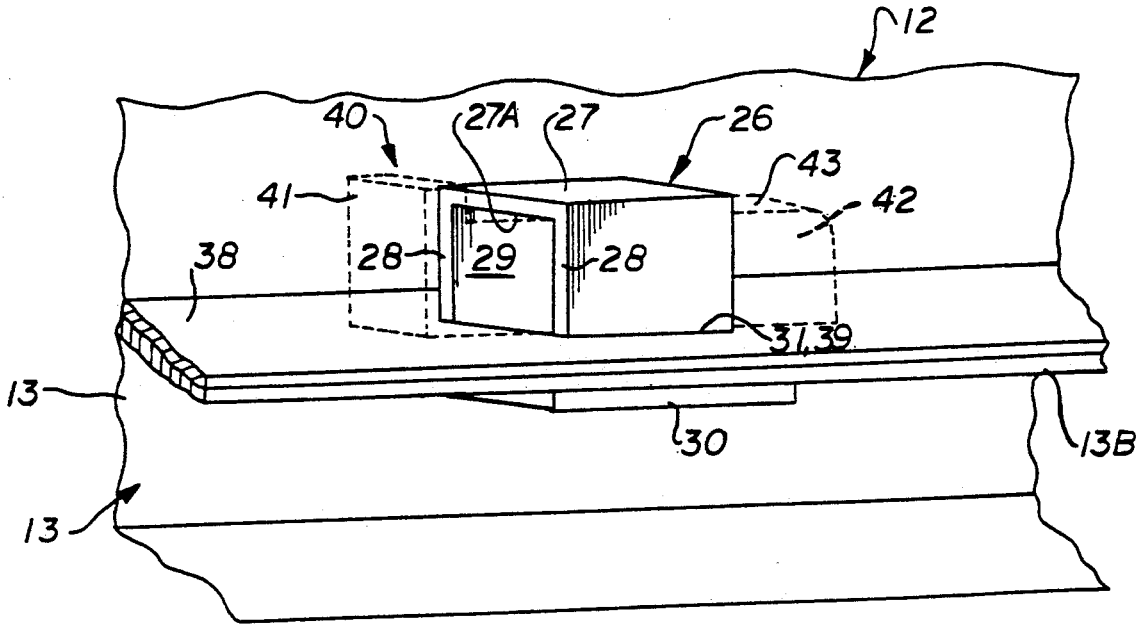
FIG. 10 is a detail of a portion of the base of the pallet and cover members in the locked position with the cover in contact with the pallet base and the wedge bar installed in the locking bracket for locking the cover onto the pallet.

As best seen in FIGS. 8 and 10, a series of hollow, inverted U-shaped locking brackets 26 are secured to the upper flange portion 13B of the C-shaped channel 13A to lock the cover 12 onto the pallet base 13, as explained hereinafter. The bracket 26 has a top wall 27 and side walls 28 defining a central opening 29 and a bottom flange 30 which is secured to the channel 13A and the inverted upper portion of the bracket 26 extends upwardly through slots 31 in the upper flange 13B of channel 13A. The interior surface 27A of the bracket top wall 27 is sloped at an angle of approximately 2°–5° relative to horizontal.

As seen in FIGS. 1 and 2, the cover member 12 is an inverted rectangular box-like construction preferably formed of metal and has a top wall 32, opposed end walls 33, and opposed longitudinal side walls 34. The corners of the cover member 12 are provided with a vertical recess 35 to slidably receive the corner posts 14. The cover member 12 has series of longitudinally spaced slots 36 formed in the longitudinal side walls 34 near their top edge to facilitate lifting the cover 12 by forklift or other conventional lifting devices. As seen in FIG. 5, each corner recess 35 has a slot 37 in one side wall near their bottom end. The slot 37 extends inwardly and upwardly a short distance to receive the horizontal portion 24 of the cover holding member 21 when it is pivoted outward to the holding position.

The open bottom end of the cover member 12 has a horizontal flange 38 extending outwardly from the bottom of the end walls 34 and side walls 33 which are received on the upper flange portion 13B of the pallet base channel 13A when the cover 12 is lowered.

Figure 9:
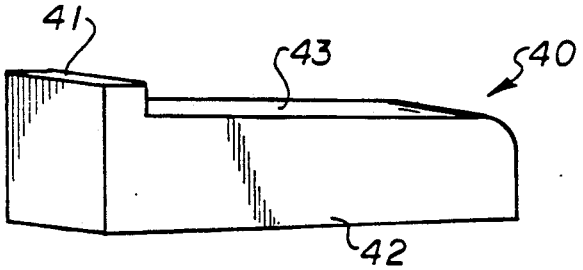
FIG. 9 is a side view of a wedge bar which is inserted into the locking bracket for locking the cover onto the pallet.

As shown in detail in FIG. 10, a series of slots 39 are formed in the flange 38 to receive the upstanding portion of the locking brackets 26 of the base channel 13A therethrough. As seen in FIGS. 9 and 10, a generally rectangular L-shaped wedge bar 40 is provided which has an upstanding vertical portion 41 and a horizontal portion 42 which has a top surface 43 sloped downwardly at an angle to frictionally engage the sloped surface 27A of the bracket 26. FIG. 10 shows the flange 38 of the cover member 12 resting on the flange 13B of the pallet channel 13A and the wedge bar 40 inserted through the opening 29 of the bracket 26 to lock the cover member 12 onto the pallet 11.

OPERATION

The cover member 12 is raised by a forklift or other lifting device to a position above the floor panel 15 of the pallet 11 and the cover holding members 21 at the upper ends of the posts 14 are rotated to engage the slots 37 in the recessed corners 35 of the cover member 12. The lifting device is then removed, and the cover member 12 is thus supported in a raised position above the floor panel 15 on the posts 14 (FIG. 2). Optionally, the cover member 12 can be completely removed from the pallet 11 (FIG. 6). The cover member 12 is preferably kept on posts 14 in the raised position since it limits the height to which items may be stacked on the floor panel and thus prevents overfilling the container.

In the cover raised or removed position, items to be shipped can be stacked on the floor panel 15 of the pallet 11 and the slings or straps 20 passed over the top of the stacked items and secured at each end to the tie-down brackets 17 mounted on the floor panel.

After the items are secured in place, the lifting device or forklift is engaged with the cover member 12 and the cover holding members 21 are pivoted to disengage them from the slots 37 in the recessed corners 35 of the cover member. The cover member 12 is then lowered by the lifting device until the flange 38 at the bottom end of the cover member engages the top flange 13 of the pallet base 13. The posts 14 received in the recessed corners 35 of the cover member 12 guide the cover member in its vertical movement. As the cover member 12 is being lowered, the locking brackets 26 are received through the slots 39 in the flange 38.

As seen in FIG. 10, the vertical portion of the wedge bar 40 is inserted into the locking bracket 26 to frictionally engage the sloped surface 27A of the bracket. The wedge bar may also be hammered to further engage it in the locking bracket and firmly lock the cover member 12 onto the pallet 11.

While this invention has been described fully and completely with special emphasis upon a preferred embodiment, it should be understood that within the scope of the appended claims the invention may be practiced otherwise than as specifically described herein.

I claim:

1. A shipping container comprising;

a pallet comprising a rectangular frame of metal channel members forming a rectangular pallet base, square metal tubing posts extending vertically from and secured to the corners of the base and a wood or metal load-supporting pallet floor on the base, tie-down means adjustably supported on said pallet floor for securing cargo to said pallet floor, a generally rectangular hollow metal cover member having a top wall, opposed end walls, opposed side walls, and an open bottom, each corner of said cover member having square cross-section vertically-extending recesses fitted inside said posts, said cover being guided for vertical sliding movement relative to said pallet, a cover-holding latch on said posts movable between an unlatched position permitting movement of said cover and a latched position supporting said cover in a raised position supported on said posts, whereby said cover may be either lifted vertically above said posts and removed from said pallet or may be moved vertically relative to said pallet within said posts between a raised position above said pallet floor for loading cargo on said pallet floor and a lowered position engaging said pallet base for completely covering said pallet floor and cargo loaded thereon.

2. A shipping container according to claim 1 wherein said tie-down means comprises a plurality of tie-down brackets supported on said pallet floor for transverse sliding movement for positioning at the sides of cargo when loaded on said floor, and strap members adapted to be secured at each end on said tie-down brackets.

3. A shipping container according to claim 2 including tie-down means on said pallet floor for securing cargo stacked thereon to said floor, comprising a plurality of tie-down brackets slidably mounted on said pallet floor for positioning at the sides of the cargo loaded on said floor, and strap members adapted to be secured at opposite ends on said tie-down brackets.

4. A shipping container according to claim 1 wherein said cover-holding latch comprises at least one rigid cover-holding member pivotally mounted on a corner post near its upper end and adapted to pivot between a non-holding position closely adjacent said corner post allowing said cover to be raised or lowered and a cover-holding position engaged with said cover to support said cover on said ports and prevent said cover from being lowered.

5. A shipping container according to claim 4 wherein said cover-holding member is an inverted generally L-shaped rod having a vertical portion pivotally mounted on said post and a horizontal portion adapted to pivot outwardly from said post and releasably engage said cover in said raised position.

6. A shipping container according to claim 1 including said pallet base having apertures for receiving the forks of a fork-lift hoist for lifting said pallet with said cover removed or with said cover on said pallet.

7. A shipping container according to claim 1 including said cover having apertures for receiving the forks of a fork-lift hoist for raising or lowering said cover relative to said pallet.

8. A shipping container according to claim 1 including locking means connected between said pallet base and said cover for securing said cover in said lowered position engaged on said pallet.

9. A shipping container according to claim 1 wherein said cover has a horizontal flange extending outwardly from said open bottom to be received on said pallet base when lowered thereon, and locking means connected between said pallet base and said horizontal flange for securing said cover in said lowered position engaged on said pallet.

10. A shipping container according to claim 9 wherein said horizontal flange has at least one aperture therethrough, said locking means comprises at least one bracket member secured on a channel member of said pallet base each of which extends through a said at least one aperture when said cover is in said lowered position, and a locking device received on one said bracket member to secure said cover onto said pallet.

11. A shipping container according to claim 1 wherein said cover has a horizontal flange extending outwardly from said open bottom to be received on said pallet base when lowered thereon and having at least one flange aperture therethrough, and including tie-down means on said pallet floor for securing cargo stacked thereon to said floor, comprising a plurality of tie-down brackets slidably mounted on said pallet floor for positioning at the sides of the cargo loaded on said floor, strap members adapted to be secured at opposite ends on said tie-down brackets, and locking means connected between a pallet base channel member and said horizontal flange for securing said cover in said lowered position engaged on said pallet.

12. A shipping container according to claim 11 wherein said locking means comprises one or more bracket members, secured on said channel member, which extend through a corresponding flange aperture when said cover is in said lowered position, and a locking device received on one bracket member to secure said cover onto said pallet.

13. A shipping container according to claim 12 wherein said one bracket member has a bracket member aperture through the portion which extends through its respective flange aperture when said cover is in said lowered position, and said locking device comprises a wedge inserted through said bracket member aperture to secure said cover on said pallet.

* * * * *